US008479421B2

(12) United States Patent
Pedersen et al.

(10) Patent No.: US 8,479,421 B2
(45) Date of Patent: Jul. 9, 2013

(54) CIRCULATING FLUID AMUSEMENT DEVICE

(75) Inventors: Bradley D. Pedersen, Mississauga (CA); Kyle Jeffs, Mississauga (CA)

(73) Assignee: Tech 4 Kids, Inc., Mississauga, ON ( * ) Notice: Subject to any disclaimer, the term of this patent is extended or adjusted under 35 U.S.C. 154(b) by 0 days.

(21) Appl. No.: 13/253,015

(22) Filed: Oct. 4, 2011

(65) Prior Publication Data

US 2012/0085675 A1 Apr. 12, 2012

Related U.S. Application Data

(60) Provisional application No. 61/389,679, filed on Oct. 4, 2010.

(51) Int. Cl.
*G09F 19/00* (2006.01)

(52) U.S. Cl.
USPC ..... 40/406; 40/410

(58) Field of Classification Search
USPC ..... 40/406, 409, 410
See application file for complete search history.

(56) References Cited

U.S. PATENT DOCUMENTS

| | | | | |
|---|---|---|---|---|
| 3,593,444 | A * | 7/1971 | Akrongold et al. | 40/407 |
| 3,655,197 | A * | 4/1972 | Milbaum | 273/146 |
| 6,006,461 | A * | 12/1999 | Snyder | 40/426 |
| 6,295,749 | B1 * | 10/2001 | Lin | 40/406 |
| 7,594,350 | B2 * | 9/2009 | Yang | 40/737 |
| 2002/0174578 | A1 * | 11/2002 | Ross | 40/409 |
| 2003/0196357 | A1 * | 10/2003 | Knapp et al. | 40/410 |
| 2006/0130377 | A1 * | 6/2006 | Lin | 40/407 |
| 2008/0110066 | A1 * | 5/2008 | Peroni | 40/430 |
| 2008/0305899 | A1 * | 12/2008 | Lin | 473/594 |

* cited by examiner

*Primary Examiner* — Casandra Davis
(74) *Attorney, Agent, or Firm* — Adam K. Sacharoff

(57) ABSTRACT

A circulating fluid amusement device is provided having a transparent globe stirred using a stirring motor, and preferably a magnetically coupled stirring system, which also includes LED lighting, in order that the circulating fluid amusement device can also act as a nightlight. The globe is removable from the base, and can be replaced with other globes, to create different effects. Additionally, the circulating fluid amusement device of the present invention is preferably provided in a packaging system which allows the circulating fluid amusement device to be tested and/or its functionality demonstrated without having to remove it from its shipping packaging.

5 Claims, 3 Drawing Sheets

CIRCULATING FLUID AMUSEMENT DEVICE

FIELD OF THE INVENTION

This invention relates to amusement devices used for entertainment and decoration that have a fluid filled transparent enclosure in which decorative particles can be suspended by fluid agitation.

BACKGROUND OF THE INVENTION

Amusement devices having decorative particles encased in a fluid filled transparent enclosures are widely known. At their most fundamental level these amusement devices (often termed snow globes, or water globes, among other variations), require manual shaking to disperse the decorative particles inside the fluid filled enclosure. However, the decorative particles soon settle to the bottom of the enclosure and some of the ornamental or amusement value of the device is lost. Almost constant manual agitation is required to maintain the desired effect of the particles swirling around the figurine. Consequently, the snow globe is usually displayed without particle movement, in a somewhat lack-luster state. This does not set off the globe to its most aesthetic and interesting advantage.

Moreover, in a store setting, where these devices are sold, the buyer frequently wishes to shake the globe to observe the effect. As such, it is typically necessary to remove one or two display items from their boxes, in order to provide sample devices for the user to test. The boxes can then become lost, the globes damaged, or the like, and this can be related to loss of sales or profits.

However, a number of authors have worked on the development of mechanical or electrical powered systems that automatically disperse the decorative particles in these amusement devices. These improved devices have used mechanical and electrical motors to drive small pumps that agitate the enclosure fluid to disperse the decorative particles. These patents include patents by Murray (U.S. Pat. No. 5,313,727), Ingram (U.S. Pat. No. 5,491,916), Powell (U.S. Pat. No. 5,502,908), Ong (U.S. Pat. No. 4,817,311), and recently by White (U.S. Pat. Nos. 6,282,820 and 6,415,535).

The resultant continuous particle movement created by these improved devices creates a pleasing visual effect for both amusement and decoration without the need for manual agitation. Viewers can enjoy the show globe in its most visually interesting and pleasing aesthetic state without the need for manually agitating the device.

However, most of these devices which are described in the prior art, use some type of mechanical stirring devices which requires a mechanical stirring rod which passes through the globe casing, and into the globe, through a seal of some sort. Eventually, this seal will fail, with a resulting loss of the liquid in the globe.

White provides a magnetic stirring system wherein a magnetic stirrer is provided inside of the snow globe, and this magnetic stirrer is magnetically linked to a magnetic impeller on a stirring motor. The magnetic stirrer can be rotated to provide a constant dispersion of particles in the amusement devices. As such, the White device eliminates the need for a mechanical stirring rod.

However, while the White device provides an improved visual effect without the use of a mechanical stirring rod, it would be desirable to enhance the visual effect further. Moreover, it would be of assistance to provide a system wherein the effect could be easily demonstrated to a potential purchaser of the product, while the product was still in its shipping box, carton, container, or the like.

SUMMARY OF THE INVENTION

This invention therefore relates to a new and useful improvements in snow globes for the continuous circulation and dispersion of particles inside the globe. The greatest advantage of this invention is that it has an improved visual effect, through use of lighting. Moreover, the present invention provides an improved snow globe that is provided in a package wherein the improved visual effect can be easily observed by a potential buyer, while still in the shipping package.

An exemplary implementation of the circulating fluid amusement device of the present invention, is a magnetically stirred device. However, the device of the present invention also includes at least one light, and most preferably, an LED light, that shines into the transparent enclosure that allows for an enhanced visual effect when the fluid is circulated. Moreover, the particles to be dispersed, are preferably metallic flakes, or the like (such as metallically coated flakes), which will reflect the light and provide a unique lighting pattern in the circulating liquid.

Further, in the device of the present invention, the transparent enclosure (or globe) is preferably not affixed to the device, and can be removed or replaced. Thus, the transparent enclosure is interchangeable, and different effects can be provided by replacement of the transparent enclosure. As a result, different effects can be achieved at different times (e.g. different "holiday" globes for different holidays, and the like).

Commonly, snow globes and the like are provide with a figurine of some sort enclosed within the transparent enclosure. In the device of the present invention, the light or lights, can shine on the figurine, as well as the swirling mass of particles, to provide an unique visual effect. However, it can be noted that the figurine is now optional, since the visual effect of the stirred and lit particles can provide its own unique visual effect. In one embodiment, therefore, the amount of particles typically found in these types of devices, is increased so that the stirred liquid on its own, resembles a reflecting mass of moving materials. Moreover, since any suitable particles can be used (e.g. reflective metal flakes, "snow" white particles, and the like, or combinations thereof), various visual effects can be provided.

With the lighting effect of the present invention, the snow globe can also be used as a nightlight, and provide the user with a uniquely appearing nightlight which is constantly in motion. Moreover, a variety of different coloured LED lights can be used so as to provide different lighting effects, and to change the colour over time as the light is used. The device can include a timing system so that it will automatically shut off after a set period of time, and thus conserve energy; —particularly when the device is battery powered.

As such, in a first aspect the present invention provides a circulating fluid amusement device which comprises a stirring system, and preferably a magnetic stirring system, and which also incorporates a lighting system that allows particles within the circulating fluid amusement device to be illuminated. As such, the circulating fluid amusement device can function as a nightlight.

More specifically, the present invention provides a circulating fluid amusement device which comprises a transparent, liquid filled enclosure, a base support for supporting said enclosure, a magnetic stirring system comprising a rotating rotor powered by a stirring motor in said base, which rotor is magnetically coupled to a stirring impeller within the enclosure, and a plurality of particles within said enclosure, wherein said device additionally comprises a lighting system that allows particles that have been agitated within said enclosure, by said impeller, to be illuminated.

In a preferred device, a timing element is incorporated into the device so that the stirring motor, and/or the nightlight will run for only a set amount of time.

Further, the stirring motor may operate intermittently, or on a pulsing basis, so that the particles can partially settle, before being stirred up again. A controller to control or modify the speed of rotation of the stirrer, can also be provided.

Still further, the present invention also provides a circulating fluid amusement device packaging system, wherein at least part of the globe of the device is visible while still in the packaging system. This could be done by a cut-out of the sales box, or by used of clear packaging such as a plastic window in a cardboard box, or by use of a plastic blister pack that would reveal the device within.

In particular, the potential buyer would have limited access to the device, and most relevantly, would be given access to an activation feature, or "test" button, that when initiated, would cause the device to operate for a limited time period (e.g. 10 to 60 seconds). This would allow the user to preview the visual effect of the circulating fluid amusement device, with a nightlight, without needing to remove display items from their packaging.

Access to the test button could be provided by an opening in the sales box, an opening in the blister pack, a flexible film over the test button that allowed it to be pressed, or the like.

As such, in a further aspect, the present invention provides a packaging system for a circulating fluid amusement device which includes access to a test button that a potential buyer can activate in order to observe the circulating fluid amusement device while it is securely maintained within its sales container.

BRIEF DESCRIPTION OF THE DRAWINGS

Embodiments of this invention will now be described by way of example only in association with the accompanying drawings in which.

DETAILED DESCRIPTION OF THE PREFERRED EMBODIMENTS

Figure 1:
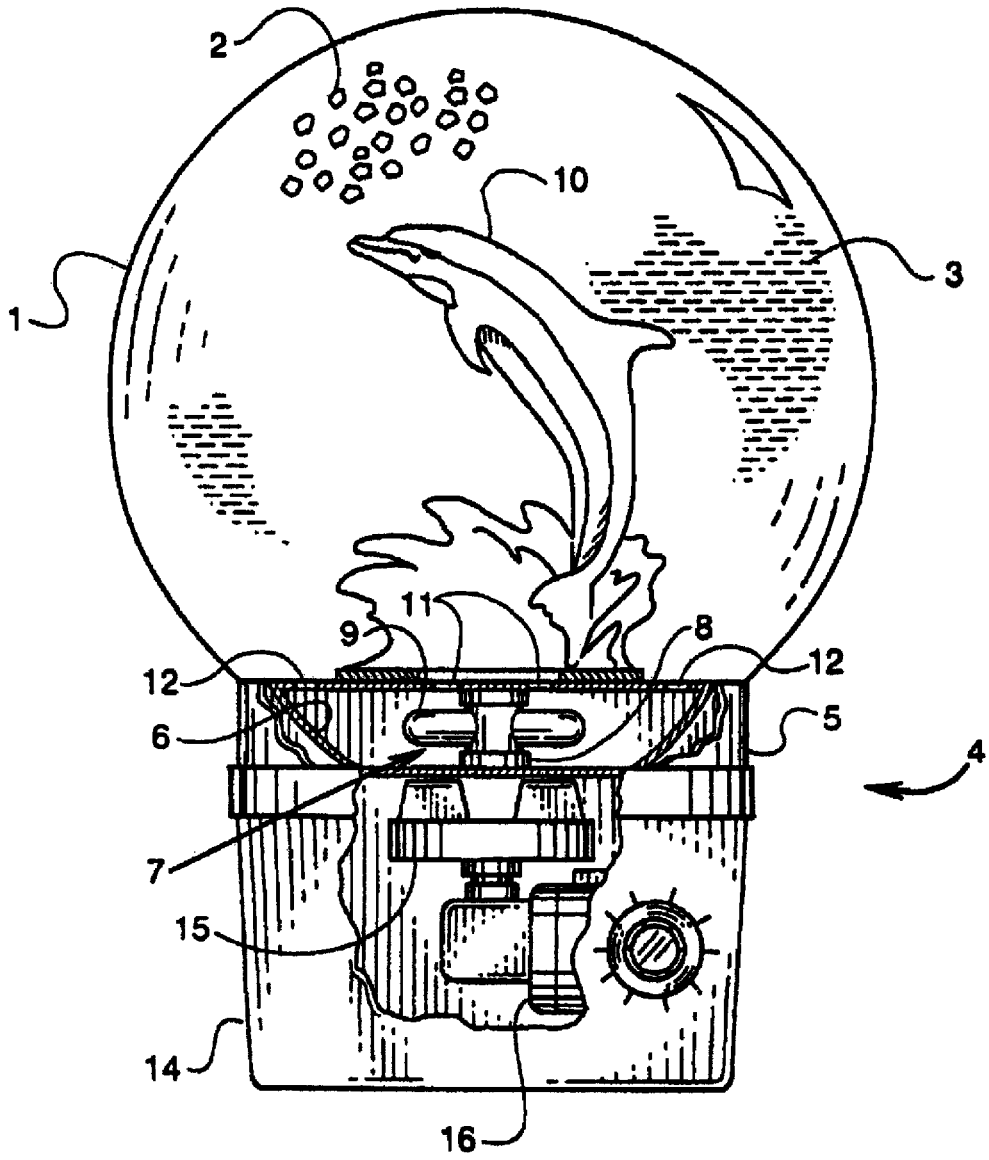
Fig. 1 (Prior Art)
FIG. 1 is a front elevation view of a complete circulating fluid amusement device, according to the prior art.

The novel features which are believed to be characteristic of the present invention, as to its structure, organization, use and method of operation, together with further objectives and advantages thereof, will be better understood from the following drawings in which a presently preferred embodiment of the invention will now be illustrated by way of example only. In the drawings, like reference numerals depict like elements.

It is expressly understood, however, that the drawings are for the purpose of illustration and description only and are not intended as a definition of the limits of the invention.

Referring to FIG. 1, a circulating fluid amusement device of the prior art is illustrated. The circulating fluid snow globe consists of a fluid filled transparent enclosure 1 with a base 4 sealing the open end of the enclosure. The enclosure is typically made from transparent plastic or glass. Disposed within the enclosure are decorative particles 2. These decorative particles typically have a snow like appearance or a metallic glitter-like appearance. The base consists of an upper housing 5 and a lower housing 14. The upper housing is in direct contact with the globe fluid.

The upper housing contains the impeller 9, suction ports 11, and discharge ports 12. The impeller 9 is rotatably attached in the upper housing 5. The upper housing is hermetically sealed from the lower housing of the base. The ornamental elements commonly displayed inside the globe, such as figurine 10 are attached above the upper housing inside the enclosure. The suction ports 11 and discharge ports 12 can be arranged in a variety of geometrical variations. However, the complex nature of the impeller 9, suction ports 11 and discharge ports 12, requires that upper enclosure 1 be permanent affixed to the device.

The lower housing 14 contains the remainder of the drive mechanism including the rotor 15, and the mechanical or electrical driver 16 for the rotor 15.

The impeller assembly 7 consists of an impeller 9 formed from a bar magnet, a hub 8 substantially fixed in the horizontal and vertical planes, but free to rotate. The major axis of the impeller 9 is mounted substantially in the horizontal plane through and affixed to the hub. Limiting the horizontal and vertical movement of the hub 8 ensures that the rotor 15 and the impeller 9 remain in alignment.

Preferably, both the rotor and impeller are magnetic in order to maximize the coupling force between the rotor and impeller, and to maintain the rotor and impeller in synchronization.

Figure 2:
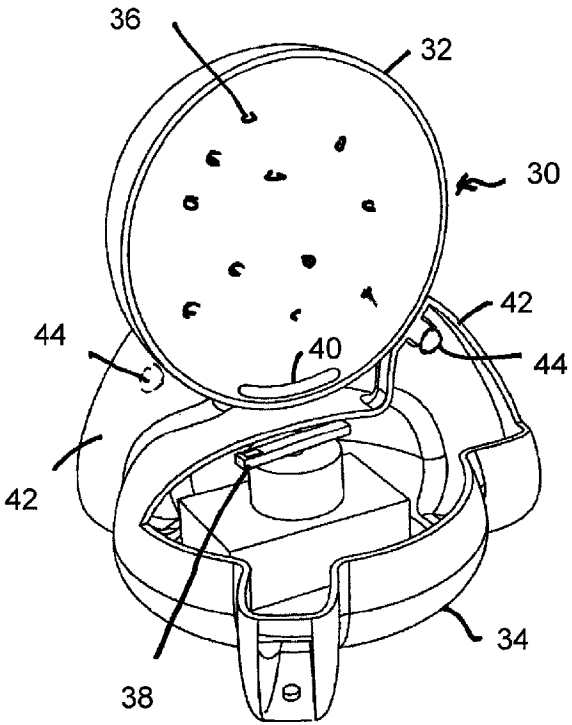
FIG. 2 is perspective view of a cut-away section of the circulating fluid amusement device of the present invention, including a nightlight function.

In FIG. 2, a circulating fluid amusement device 30, of the present invention is shown, having a transparent fluid filled globe 32 with a base 34. Disposed within globe 32, are decorative particles 36. These decorative particles 36 can have a snow like appearance or, more preferably, have a metallic glitter-like appearance. Base 34 has a central section containing a rotor 38. Magnetically linked impeller 40 is contained with globe 32.

Impeller 40 can be a magnet, or can simply be a magnetic article which would be attracted to a magnet on rotor 38. Any suitable arrangement for rotor and impeller can be used, provided that the rotor and impeller are magnetically linked.

However, impeller 40 is preferably a loose article within transparent globe 32, and as such, is allowed to move within globe 32. Typically, it will be biased towards the bottom of globe 32, and thus be in operational contact with rotor 38. Thus, globe 32 can be removed from the system, and replaced back in any orientation. Impeller 40 will fall to the lowest point of globe 40, and be in position for rotation.

When rotating, impeller 40 agitates the liquid in the area of impeller 40, and thus causes the fluid to circulate, and particles 36, are dispersed within the fluid.

Figure 3A:
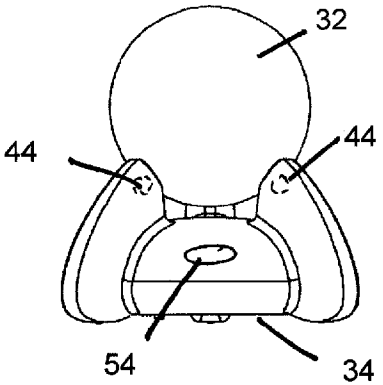
FIG. 3 is a collection of planar views of the device of the present invention.
Figure 3B:
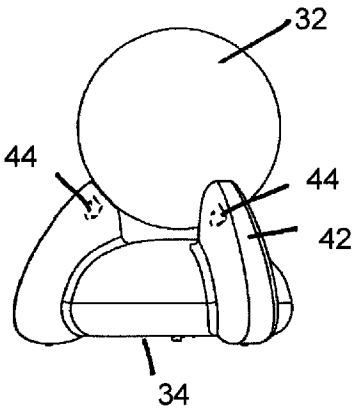

In FIG. 2 and FIGS. 3A and 3B, it can be seen that globe 32 rests on three outer pylons 42, which are fitted with LED lights 44 at the ends of the pylons, and adjacent to the globe. The light from LED lights 44 project light into globe 32. It will be clear to the skilled artisan that a wide variety of shapes and sizes can be used for the base. The three LED lights in the pylons are preferably three different colours and the effect on the decorative particles 36 is modified by using the different LED lights individually.

Alternatively, only one pylon might contain a light, or a light could be provided in any other suitable location, such as the center of base 34, directly over impeller 38. Further, while three pylons are shown, other numbers of pylons might be used, or any suitable size and shape for base 34 can be used.

On the front of base 34, is a button 54, for turning the device on or off.

Figure 3C:
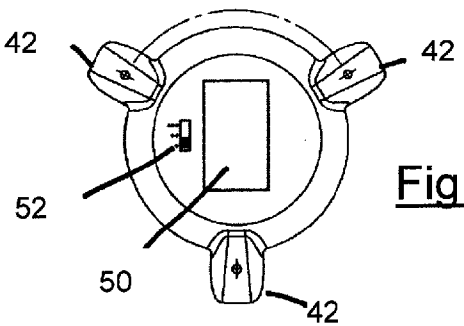

In FIG. 3C, the bottom of base 34 is shown, and includes a battery compartment 50, and a functionality switch 52. The entire circulating fluid amusement device can be powered by any suitable power source such as electric household electricity supplies. However, the device is preferably battery powered.

Figure 4:
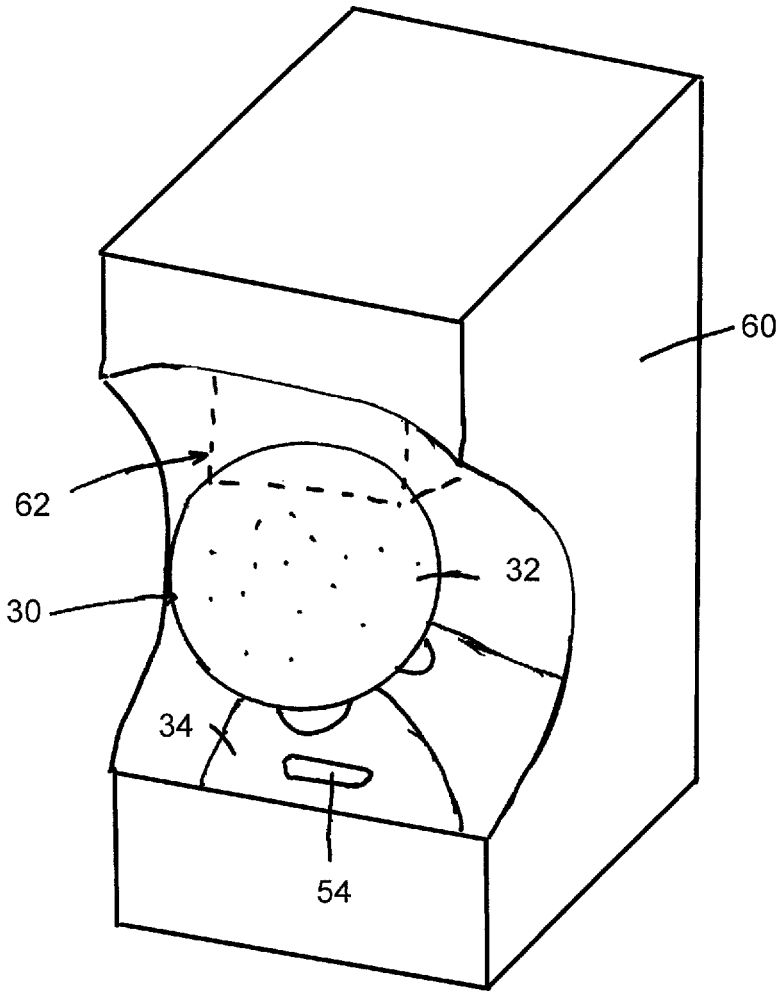
FIG. 4 is a view of a circulating fluid amusement device packaging system, according to the present invention.

In FIG. 4, the circulating fluid amusement device 30 of the present invention is shown enclosed in a shipping box 60. The device 30 is secured within box using any conventional means. Base 34 can be partially encased within box 60, and at least part of globe 32 is held in place by a clear plastic blister pack 33, which holds globe 32 in place. Globe 32 is preferably still visible through blister pack 33.

Preferably, though, at least part of globe 32 is visible through an opening 62 in box 60. Base 34 is only partially shown, but it should be noted that button 54 is clearly available for the potential buyer to press. While still in box 60, pressing button 54 initiates a ten second stirring motion, with lights, so that the user can clearly see the functionality of the device, without having to remove it from its packaging.

After removal of the device 30 from box 60, switch 52 can be moved from a shipping "test" position, to a normal operating position, in which front button 54 turns the device on or off. In particular, switch 52 can be moved from a central control on or off position, to a timer function wherein the device will operate for the 10 second period (or any other set period of time), when button 54 is pressed.

Thus, it is apparent that there has been provided, in accordance with the present invention, a circulating fluid amusement device which fully satisfies the goals, objects, and advantages set forth hereinbefore. Therefore, having described specific embodiments of the present invention, it will be understood that alternatives, modifications and variations thereof may be suggested to those skilled in the art, and that it is intended that the present specification embrace all such alternatives, modifications and variations as fall within the scope of the appended claims.

Additionally, for clarity and unless otherwise stated, the word "comprise" and variations of the word such as "comprising" and "comprises", when used in the description and claims of the present specification, is not intended to exclude other additives, components, integers or steps.

Moreover, the words "substantially" or "essentially", when used with an adjective or adverb is intended to enhance the scope of the particular characteristic; e.g., substantially planar is intended to mean planar, nearly planar and/or exhibiting characteristics associated with a planar element.

Also, unless otherwise specifically noted, all of the features described herein may be combined with any of the above aspects, in any combination.

Further, use of the terms "he", "him", or "his", is not intended to be specifically directed to persons of the masculine gender, and could easily be read as "she", "her", or "hers", respectively. Similarly, use of terms such as top, bottom sides, front, back, and the like, are used to describe the relative positioning of various components, when the device of the present invention, is used in its normal configuration.

Finally, while this discussion has addressed prior art known to the inventor, it is not an admission that all art discussed is citable against the present application.

What is claimed is:

1. A circulating fluid amusement device comprising:

a transparent, liquid filled enclosure, the enclosure having a three-dimensional geometrical shape, the three-dimensional geometrical shape having at least a first surface region and a second surface region such that when the three-dimensional geometrical shape is oriented in a first orientation the first surface region is positioned below the second surface region and when the three-dimensional geometrical shape is oriented in a second orientation the first surface region is positioned above the second surface region, the enclosure housing a stirring impeller and a plurality of particles, wherein the stirring impeller has magnetic properties and is freely moveable within said enclosure, such that the stirring impeller tends to move towards the surface which is closure to a defined bottom of the enclosure;

a base support configured to removable support the geometrical shaped enclosure in more than one orientation, such that when the enclosure is positioned in the first orientation on said base support, the enclosure is removable from and is returnable to said base support in the second orientation; and a magnetic stirring system positioned within the base support, the magnetic stirring system having a rotating rotor powered by a stirring motor, the rotating rotor having magnetic properties such that when the enclosure is positioned on said base support in one orientation, of the more than one orientations, the stirring impeller within the enclosure moves towards the bottom of the enclosure closer to the first or second surface regions of the enclosure that is oriented below the other surface region and becomes magnetically coupled to said rotating rotor, wherein when the device is activated, the rotating rotor rotates the stirring impeller to move the plurality of particles.

2. The device of claim 1 further comprising a lighting system secured to the base support and configured to illuminate at least a portion of the enclosure and wherein the plurality of particles include a metallic portion, such that when illuminated the plurality of particles reflect the illumination.

3. The device of claim 2, wherein the lighting system includes one or more LED lights.

4. The device of claim 2 further comprising a timing system in communication with the lighting system and the stirring motor, the timing system having a mechanism to deactivate the lighting system and/or the stirring motor after a predetermined period of time.

5. A circulating fluid amusement device comprising:

a liquid filled enclosure, the enclosure having a three-dimensional geometrical shape, the enclosure have at least a first surface region positioned above a second surface region, the enclosure housing a magnetic stirring impeller and a plurality of particles, the stirring impeller being freely moveable within said enclosure, such that the stirring impeller tends to move towards a lower surface of the enclosure, when the enclosure is positioned in substantially any orientation;

a base support configured to receive the first and second surface regions and is further configured to removably support the geometrical shaped enclosure, such that the enclosure is removably from and returnable to the base support in at least two different orientations configured such that a first orientation corresponds to having the first surface region positioned in the base support with the second surface region positioned above the first surface region and further configured such that a second orientation corresponds to having the second surface region positioned in the base support with the first surface region positioned above the second surface region; and a magnetic stirring system positioned within the base support, the magnetic stirring system having a magnetic rotating rotor powered by a stirring motor, wherein, when the enclosure is positioned on said base support in different orientations, the stirring impeller within the enclosure moves towards the lower surface of the enclosure to become magnetically coupled to said rotating rotor such that when the device is activated, the rotating rotor rotates the stirring impeller to move the plurality of particles.

* * * * *